US010508609B2

(12) United States Patent
Nagakura et al.

(10) Patent No.: US 10,508,609 B2
(45) Date of Patent: Dec. 17, 2019

(54) CONTROL DEVICE FOR INTERNAL COMBUSTION ENGINE USING IMBALANCE DIAGNOSIS AND ABNORMALITY DETERMINATION

(71) Applicants: TOYOTA JIDOSHA KABUSHIKI KAISHA, Toyota-shi, Aichi-ken (JP); Toyota Technocraft Co., Ltd., Minato-ku, Tokyo (JP)

(72) Inventors: Keisuke Nagakura, Anjo (JP); Jun Hattori, Tokyo (JP)

(73) Assignees: Toyota Jidosha Kabushiki Kaisha, Toyota-shi, Aichi-ken (JP); Toyota Technocraft Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 15/690,876

(22) Filed: Aug. 30, 2017

(65) Prior Publication Data

US 2018/0066621 A1 Mar. 8, 2018

(30) Foreign Application Priority Data

Sep. 2, 2016 (JP) ..... 2016-171833

(51) Int. Cl.

| | |
|---|---|
| ***F02D 41/22*** | (2006.01) |
| ***F02D 41/30*** | (2006.01) |
| ***F02D 41/38*** | (2006.01) |
| ***F02D 41/14*** | (2006.01) |
| ***F02D 41/00*** | (2006.01) |

(52) U.S. Cl.

CPC ..... *F02D 41/221* (2013.01); *F02D 41/0085* (2013.01); *F02D 41/1454* (2013.01);

(Continued)

(58) Field of Classification Search

CPC ..... F02D 41/22–222; F02D 41/3082; F02D 41/1454; F02D 41/3836–3854;

(Continued)

(56) References Cited

U.S. PATENT DOCUMENTS 5,615,657 A * 4/1997 Yoshizawa ..... F02D 41/32 123/478
5,975,047 A * 11/1999 Kamura ..... F02D 37/02 123/305

(Continued)

FOREIGN PATENT DOCUMENTS

JP H11-037380 A 2/1999
JP 2001-164961 A 6/2001

(Continued)

*Primary Examiner* — Lindsay M Low
*Assistant Examiner* — Robert A Werner
(74) *Attorney, Agent, or Firm* — Finnegan, Henderson, Farabow, Garrett & Dunner, LLP

(57) ABSTRACT

When imbalance diagnosis is not executed, target fuel pressure is set based on a rotation speed and volumetric efficiency of an engine, and when the imbalance diagnosis is executed, fuel pressure smaller than the target fuel pressure settable when the imbalance diagnosis is not executed is set as the target fuel pressure, and a high-pressure fuel pump that supplies fuel to a delivery pipe connected to the in-cylinder injection valve, is driven and controlled such that detected fuel pressure becomes the target fuel pressure. With this, it is possible to execute the imbalance diagnosis with higher accuracy.

6 Claims, 2 Drawing Sheets

(52) U.S. Cl.
CPC ..... *F02D 41/22* (2013.01); *F02D 41/3094* (2013.01); *F02D 41/38* (2013.01); *F02D 41/3845* (2013.01); *F02D 2041/224* (2013.01); *F02D 2041/389* (2013.01); *F02D 2200/0602* (2013.01); *F02D 2200/101* (2013.01); *F02D 2250/04* (2013.01)

(58) Field of Classification Search
CPC ..... F02D 2041/223–226; F02D 1/00; F02D 2001/085; F02D 2001/009
USPC ..... 701/103, 104, 107; 123/435, 456; 73/114.38, 114.43, 114.45, 114.51
See application file for complete search history.

(56) References Cited

U.S. PATENT DOCUMENTS

2009/0084348 A1* 4/2009 Batenburg ..... F02D 35/023 123/294
2011/0219861 A1 9/2011 Kayama et al.
2012/0245824 A1* 9/2012 Miura ..... F02D 41/22 701/104
2015/0167575 A1* 6/2015 Matsumoto ..... F02D 41/1495 701/102

FOREIGN PATENT DOCUMENTS

| | | | |
|---|---|---|---|
| JP | 2006-316655 | A | 11/2006 |
| JP | 2007-016687 | A | 1/2007 |
| JP | 2010-185309 | A | 8/2010 |
| JP | 2011-185159 | A | 9/2011 |
| JP | 2012-172607 | | 9/2012 |
| JP | 2013-24040 | | 2/2013 |
| JP | 2014-080910 | A | 5/2014 |
| JP | 2014-202157 | A | 10/2014 |
| JP | 2014-202163 | | 10/2014 |

* cited by examiner

CONTROL DEVICE FOR INTERNAL COMBUSTION ENGINE USING IMBALANCE DIAGNOSIS AND ABNORMALITY DETERMINATION

CROSS-REFERENCE TO RELATED APPLICATIONS

This application claims priority to Japanese Patent Application No. 2016-171833 filed on Sep. 2, 2016, which is incorporated herein by reference in its entirety.

BACKGROUND

1. Technical Field

The present disclosure relates to a control device for an internal combustion engine, and in particular, to a control device for an internal combustion engine that includes a multi-cylinder internal combustion engine having an in-cylinder injection valve, and a fuel supply device having a high-pressure fuel pump.

2. Description of Related Art

Hitherto, as this kind of control device for an internal combustion engine, a control device that includes a multi-cylinder internal combustion engine having an in-cylinder injection valve (in-cylinder injector) has been suggested (for example, see Japanese Unexamined Patent Application Publication No. 2013-24040). This device performs diagnosis regarding whether or not imbalance of a fuel injection amount between cylinders occurs based on fluctuation of an air-fuel ratio.

SUMMARY

On the other hand, in a control device for an internal combustion engine that includes a fuel supply device having a high-pressure fuel pump configured to pressurize fuel from a fuel tank and to supply fuel to a supply flow passage connected to an in-cylinder injection valve, pulsation occurs in fuel pressure in the supply flow passage due to the driving of the high-pressure fuel pump. When pulsation occurs in fuel pressure, even when no abnormality occurs in a fuel injection system, variation in fuel pressure occurs at an injection timing between the cylinders, fluctuation of the air-fuel ratio or fluctuation of rotation of the internal combustion engine becomes large to some extent. In particular, when target fuel pressure of the high-pressure fuel pump is high, the amplitude of pulsation of fuel pressure in the supply flow passage becomes larger than when the target fuel pressure of the high-pressure fuel pump is low and the fluctuation of the air-fuel ratio or the fluctuation of the rotation speed of the internal combustion engine becomes large. For this reason, the accuracy of imbalance diagnosis based on the fluctuation of the air-fuel ratio or the fluctuation of the rotation speed of the internal combustion engine is degraded.

In consideration of the above-described problem, the present disclosure provides a control device for an internal combustion engine that executes imbalance diagnosis of a fuel injection amount between cylinders with higher accuracy.

According to an aspect of the present disclosure, there is provided a control device for a multi-cylinder internal combustion engine including an in-cylinder injection valve configured to inject fuel into a cylinder of the internal combustion engine. The control device includes a fuel supply device and an electronic control unit. The fuel supply device includes a high-pressure fuel pump configured to pressurize fuel from a fuel tank and to supply the fuel to a supply flow passage connected to the in-cylinder injection valve. The electronic control unit is configured to: (i) control the high-pressure fuel pump such that fuel pressure in the supply flow passage becomes target fuel pressure, (ii) execute imbalance diagnosis for determining whether or not imbalance of a fuel injection amount between cylinders occurs based on fluctuation of an air-fuel ratio or fluctuation of rotation of the internal combustion engine, and (iii) set a value of the fuel pressure to the target fuel pressure, the value of the fuel pressure being a value of the fuel pressure when the imbalance diagnosis is executed and being smaller than a value of the fuel pressure when the imbalance diagnosis is not executed.

In the control device, the electronic control unit may be configured to calculate the target fuel pressure based on volumetric efficiency and a rotation speed of the internal combustion engine, the volumetric efficiency being a ratio of volume of air actually sucked in one cycle to stroke volume of the internal combustion engine per cycle. In the control device, the electronic control unit may be configured to set a given value of the fuel pressure to the target fuel pressure, the given value being a value of the fuel pressure when the imbalance diagnosis is executed and being smaller than a value of the fuel pressure when the imbalance diagnosis is not executed.

With the configuration of the control device for an internal combustion engine of the present disclosure, the imbalance diagnosis for determining whether or not imbalance of the fuel injection amount between the cylinders occurs based on fluctuation of an air-fuel ratio or fluctuation of rotation of the internal combustion engine is executed. When the imbalance diagnosis is executed, the value smaller than when the imbalance diagnosis is not executed is set to the target fuel pressure, and the high-pressure fuel pump is controlled such that the fuel pressure in the supply flow passage connected to the in-cylinder injection valve becomes the target fuel pressure. With this, since, when the imbalance diagnosis is executed, pulsation of fuel pressure becomes smaller than that when imbalance diagnosis is not executed, it is possible to reduce variation in fuel pressure at an injection timing between the cylinders when no abnormality occurs in a fuel injection system, to reduce variation in fuel injection amount between the cylinders, and to reduce the fluctuation of the air-fuel ratio or fluctuation of the rotation speed of the internal combustion engine. Therefore, it is possible to execute the imbalance diagnosis with higher accuracy.

In the control device, the electronic control unit may be configured to determine whether or not the imbalance occurs using an inclination of change in the air-fuel ratio. In the control device, the electronic control unit may be configured to: (i) calculate a required time required when a crankshaft of the internal combustion engine rotates by a predetermined rotation angle, and (ii) determine whether or not the imbalance occurs using the required time. With this, it is possible to execute the imbalance diagnosis using the inclination of change in the air-fuel ratio or the required time with higher accuracy.

In the control device for an internal combustion engine of the present disclosure, the internal combustion engine may have a port injection valve configured to inject fuel to an intake port, and the fuel supply device may have a first fuel pump and a second fuel pump. The first fuel pump may be configured to: (i) pressurize fuel from the fuel tank, and (ii) supply high-pressure fuel to a first supply flow passage as the supply flow passage. The second fuel pump may be configured to supply fuel from the fuel tank to a second supply flow passage connected to the port injection valve. The electronic control unit may be configured to: (i) control the internal combustion engine such that the internal combustion engine operates in any of a port injection mode in which the internal combustion engine operates with fuel injection exclusively from the port injection valve, an in-cylinder injection mode in which the internal combustion engine operates with fuel injection exclusively from the in-cylinder injection valve, and a common injection mode in which the internal combustion engine operates with fuel injection from the port injection valve and the in-cylinder injection valve, and (ii) set a value of the fuel pressure to the target fuel pressure, the value of the fuel pressure being a value of the fuel pressure when the imbalance diagnosis is executed in the in-cylinder injection mode and being smaller than a value of the fuel pressure when the imbalance diagnosis is not executed in the an in-cylinder injection mode. With the configuration of the control device for an internal combustion engine, even in an internal combustion engine device that has an internal combustion engine having an in-cylinder injection valve and a port injection valve, it is possible to execute imbalance diagnosis in an in-cylinder injection mode with higher accuracy.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Next, a mode for carrying out the present disclosure will be described in connection with an embodiment.

Figure 1:
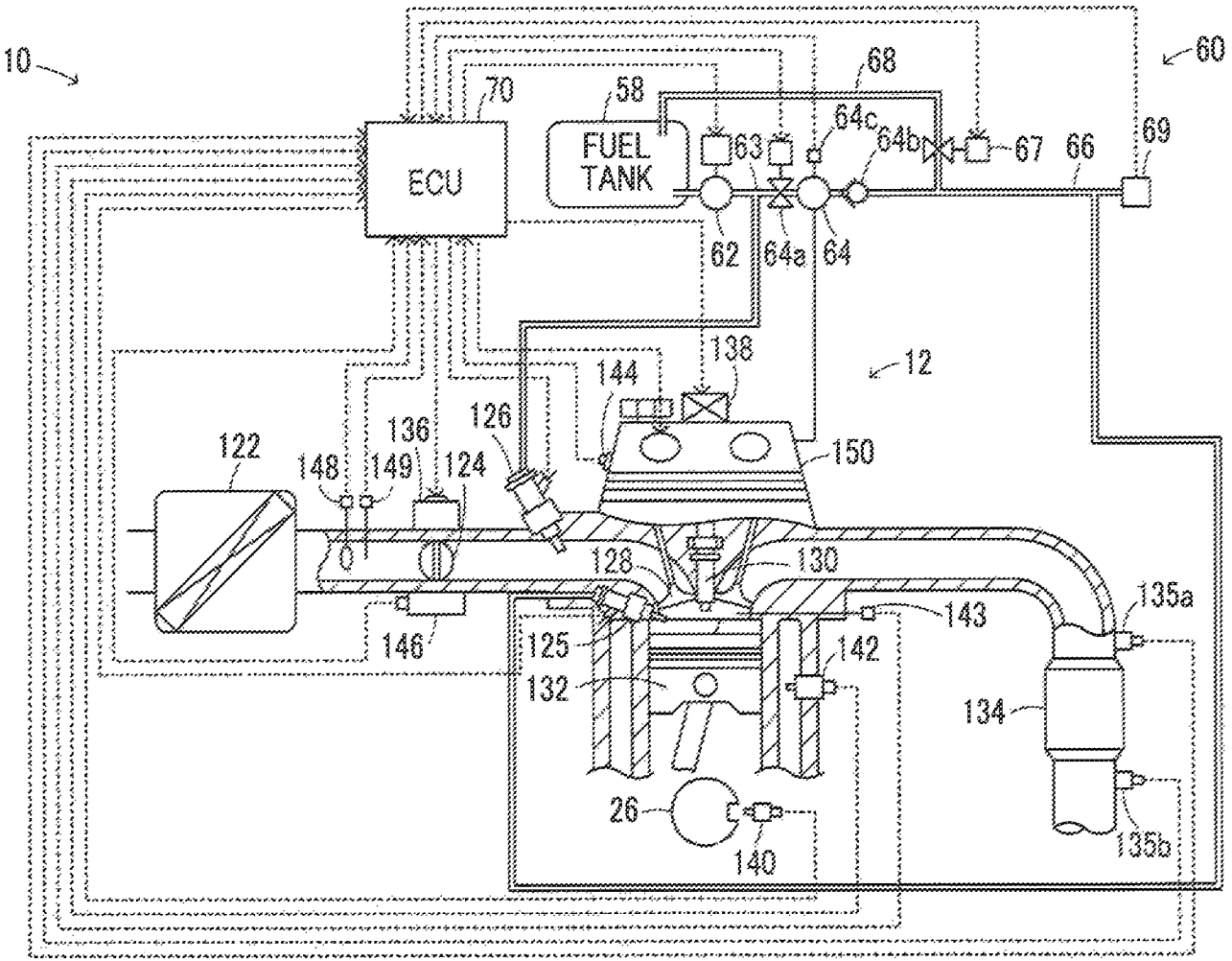
FIG. 1 is a configuration diagram showing the outline of the configuration of an internal combustion engine device 10 as an embodiment of the present disclosure.

FIG. 1 is a configuration diagram showing the outline of the configuration of an internal combustion engine device 10 as an embodiment of the present disclosure. As shown in the drawing, the internal combustion engine device 10 of the embodiment includes an engine 12, a fuel supply device 60, and an electronic control unit (hereinafter, referred to as an "ECU") 70 that operates and controls the engine 12. The internal combustion engine device 10 is mounted in a vehicle that travels exclusively using power from the engine 12, a hybrid vehicle that travels using power from the engine 12 and a motor (not shown), or the like.

The engine 12 is configured as an internal combustion engine that has a plurality of cylinders (for example, four cylinders, six cylinders, eight cylinders, or the like), and outputs power using fuel, such as gasoline or diesel. As shown in the drawing, the engine 12 has an in-cylinder injection valve 125 that injects fuel into a cylinder, and a port injection valve 126 that injects fuel to an intake port. The engine 12 has the in-cylinder injection valve 125 and the port injection valve 126, thereby to be operable in any of a port injection mode, an in-cylinder injection mode, and a common injection mode. In the port injection mode, air cleaned by an air cleaner 122 is sucked through a throttle valve 124 and fuel is injected from a port injection valve 126 to mix air and fuel. Then, the air-fuel mixture is sucked into a combustion chamber through an intake valve 128 and expanded and combusted with electric spark by an ignition plug 130, and reciprocating motion of a piston 132 pushed by produced energy is converted to rotational motion of a crankshaft 26. In the in-cylinder injection mode, air is sucked into the combustion chamber like the port injection mode, and fuel is injected from the in-cylinder injection valve 125 in the middle of an intake stroke or after a compression stroke is reached and expanded and combusted with electric spark by the ignition plug 130 to obtain rotational motion of the crankshaft 26. In the common injection mode, fuel is injected from the port injection valve 126 in a case of sucking air into the combustion chamber or fuel is injected, and fuel is injected from the in-cylinder injection valve 125 in the intake stroke or the compression stroke and expanded and combusted with electric spark by the ignition plug 130 to obtain rotational motion of the crankshaft 26. The injection modes are switched based on an operation state of the engine 12. Exhaust gas from the combustion chamber is discharged to outside air through an exhaust gas control device 134 having an exhaust gas removing catalyst (three-way catalyst) that removes harmful components, such as carbon monoxide (CO), hydrocarbon (HC), and nitrogen oxide (NOx).

The fuel supply device 60 is configured as a device that supplies fuel of a fuel tank 58 to the in-cylinder injection valve 125 or the port injection valve 126 of engine 12. The fuel supply device 60 includes an electrically driven fuel pump 62 that supplies fuel of the fuel tank 58 to a fuel pipe 63 connected to the port injection valve 126, and a high-pressure fuel pump 64 that pressurizes fuel in the fuel pipe 63 and supplies fuel to a delivery pipe 66 connected to the in-cylinder injection valve 125. The fuel supply device 60 includes a relief valve 67 that is provided in a relief pipe 68 connected to the delivery pipe 66 and the fuel tank 58, and is able to reduce the pressure (fuel pressure) of fuel in the delivery pipe 66 by a pressure difference from atmospheric pressure. The high-pressure fuel pump 64 is a pump that is driven by power (rotation of a camshaft) from the engine 12 to pressurize fuel in the fuel pipe 63. The high-pressure fuel pump 64 has an electromagnetic valve 64*a* that is connected to an inlet thereof to be opened or closed in a case of pressurizing fuel, and a check valve 64*b* that is connected to an outlet thereof to prevent a backflow of fuel and to retain fuel in the delivery pipe 66. With this, the high-pressure fuel pump 64 sucks fuel from the fuel pump 62 when the electromagnetic valve 64*a* is opened during the operation of the engine 12 and discontinuously pumps fuel compressed by a plunger (not shown) operated with power from the engine 12 to the delivery pipe 66 through the check valve 64*b* when the electromagnetic valve 64*a*, thereby pressurizing fuel supplied to the delivery pipe 66. Fuel in the delivery pipe 66 is pulsed according to the rotation (the rotation of the camshaft) of the engine 12. The relief valve 67 is an electromagnetic valve that is opened so as to prevent fuel pressure in the delivery pipe 66 from becoming excessive and so as to reduce fuel pressure in the delivery pipe 66 when the engine 12 is stopped. When the relief valve 67 is opened, fuel in the delivery pipe 66 is returned to the fuel tank 58 through the relief pipe 68.

Though not shown, the ECU 70 is configured as a microprocessor centering on a CPU, and includes, in addition to the CPU, a ROM that stores a processing program, a RAM that temporarily stores data, an input/output port, and a communication port.

Various signals necessary for operating and controlling the engine 12 are input to the ECU 70 through the input port. As the signals input to the ECU 70, for example, a crank position θcr from a crank position sensor 140 that detects a rotation position of the crankshaft 26, a coolant temperature Tw from a coolant temperature sensor 142 that detects a temperature of a coolant of the engine 12, and the like can be exemplified. An in-cylinder pressure Pin from a pressure sensor 143 attached in the combustion chamber, a cam position θca from a cam position sensor 144 that detects a rotation position of an intake camshaft opening or closing the intake valve 128 or an exhaust camshaft opening or closing an exhaust valve, and the like can also be exemplified. A throttle opening degree TH from a throttle valve position sensor 146 that detects a position of the throttle valve 124, an intake air amount Qa from an air flowmeter 148 attached to an intake pipe, an intake air temperature Ta from a temperature sensor 149 attached to the intake pipe, and the like can also be exemplified. An air-fuel ratio A/F from an air-fuel ratio sensor 135*a* attached to an exhaust pipe, an oxygen signal O2 from an oxygen sensor 135*b* attached to the exhaust pipe, and the like can also be exemplified. A rotation speed Np from a rotation speed sensor 64*c* that detects a rotation speed of the high-pressure fuel pump 64, fuel pressure Pf (hereinafter, referred to as "detected fuel pressure Pfdet") from a fuel pressure sensor 69 that detects fuel pressure (fuel pressure of fuel supplied to the in-cylinder injection valve 125) in the delivery pipe 66 of the fuel supply device 60, and the like can also be exemplified.

Various control signals for operating and controlling the engine 12 are output from the ECU 70 through the output port. As the signals output from the ECU 70, for example, a drive signal to the in-cylinder injection valve 125, a drive signal to the port injection valve 126, a drive signal to a throttle motor 136 that regulates the position of the throttle valve 124, a control signal to an ignition coil 138 integrated with an igniter, and the like can be exemplified. A control signal to a variable valve timing mechanism 150 that is able to vary an opening/closing timing of the intake valve 128, a drive signal to the fuel pump 62, a drive signal to the electromagnetic valve 64*a* of the high-pressure fuel pump 64, a drive signal to the relief valve 67, and the like can also be exemplified.

The ECU 70 calculates the rotation speed Ne of the engine 12 based on the crank position θcr from the crank position sensor 140 or calculates volumetric efficiency (a ratio of volume of air actually sucked in one cycle to stroke volume of the engine 12 per cycle) KL based on the intake air amount Qa from the air flowmeter 148 and the rotation speed Ne of the engine 12.

In the internal combustion engine device 10 of the embodiment configured as above, the ECU 70 performs intake air amount control, fuel injection control, and ignition control of the engine 12 such that the engine 12 is operated with target rotation speed Ne* and target torque Te*. The ignition control is not characteristic of the present disclosure, and thus, detailed description thereof will be omitted. In the intake air amount control, target air amount Qa* is set based on the target torque Te*, a target throttle opening degree TH* is set such that the intake air amount Qa becomes the target air amount Qa*, and the throttle motor 136 is driven and controlled such that the throttle opening degree TH becomes the target throttle opening degree TH*. In the fuel injection 6 control, first, an injection mode for execution is set from the port injection mode, the in-cylinder injection mode, and the common injection mode based on an operation state of the engine 12 (for example, the rotation speed Ne or volumetric efficiency KL of the engine 12). Subsequently, target fuel injection amounts Qfd*, Qfp* of the in-cylinder injection valve 125 and the port injection valve 126 are set based on the target air amount Qa* and the injection mode for execution such that the air-fuel ratio A/F becomes a target air-fuel ratio A/F* (for example, a stoichiometric air-fuel ratio). Then, target fuel injection times τfd*, τfp* of the in-cylinder injection valve 125 and the port injection valve 126 are set based on the target fuel injection amounts Qfd*, Qfp*, and the in-cylinder injection valve 125 and the port injection valve 126 are driven and controlled such that fuel injections for target fuel injection times τfd*, τfp* are performed from the in-cylinder injection valve 125 and the port injection valve 126.

The target fuel injection time τfd* of the in-cylinder injection valve 125 is set based on the target fuel injection amount Qfd* and the detected fuel pressure Pfdet from the fuel pressure sensor 69. Specifically, the target fuel injection time τfd* is set to be longer when the target fuel injection amount Qfd* is large than when the target fuel injection amount Qfd* is small. In detail, the target fuel injection time τfd* is set to be longer when the target fuel injection amount Qf* is larger and to be shorter when fs is higher. The target fuel injection amount τfp* of the port injection valve 126 is set based on the target fuel injection amount Qfp*. Specifically, the target fuel injection time τfp* is set to be longer when the target fuel injection amount Qfp* is large than when the target fuel injection amount Qfp* is small. In detail, the target fuel injection time τfp* is set to be longer when the target fuel injection amount Qf* is larger.

In a case of operating the engine 12, the high-pressure fuel pump 64 (electromagnetic valve 64*a*) is driven and controlled such that the detected fuel pressure Pfdet becomes target fuel pressure Pf*. The target fuel pressure Pf* is set based on the operation state of the engine 12 (the rotation speed Ne or volumetric efficiency KL of the engine 12). In the embodiment, the in-cylinder injection mode is set as the injection mode for execution and the fuel injection control is performed until a certain time elapses after the operation of the engine 12 starts.

When a diagnosis execution condition for executing imbalance diagnosis is established, the ECU 70 performs imbalance diagnosis regarding whether or not imbalance of a fuel injection amount between cylinders occurs in the in-cylinder injection mode or in the port injection mode. The imbalance diagnosis execution condition includes a diagnosis precondition for executing the imbalance diagnosis and a determination requirement requiring the execution of the imbalance diagnosis. It is determined that the diagnosis precondition is established when the coolant temperature Tw is equal to or higher than a threshold Twref. The threshold Twref is a threshold that is used for determination regarding whether or not warming-up of the engine 12 is completed. For example, for the threshold Twref, 70° C., 75° C., 80° C., or the like can be used. It is determined that the determination requirement is established when an operation point of the engine 12 is within a determination region for executing (suitable for execution of) the imbalance diagnosis in the in-cylinder injection mode or the port injection mode. The determination region is defined as a region where the rotation speed Ne of the engine 12 is equal to or higher than a predetermined rotation speed Ne1 and equal to or lower than a predetermined rotation speed Ne2 and the volumetric efficiency KL of the engine 12 is equal to or higher than predetermined efficiency KL1 and equal to or lower than predetermined efficiency KL2. For the predetermined rotation speed Ne1, for example, 1150 rpm, 1200 rpm, 1250 rpm, or the like can be used. For the predetermined rotation speed Ne2, for example, 1950 rpm, 2000 rpm, 2050 rpm, or the like can be used. For the predetermined efficiency KL1, for example, 38%, 40%, 42%, or the like can be used. For the predetermined efficiency KL2, for example, 63%, 65%, 67%, or the like can be used. When the two conditions including the diagnosis precondition and the determination requirement are established, the imbalance diagnosis execution conditions are established. In the imbalance diagnosis, rich imbalance diagnosis regarding whether or not a fuel injection amount of any cylinder becomes larger than fuel injection amounts of other cylinders, and lean imbalance diagnosis regarding whether or not a fuel injection amount of any cylinder becomes smaller than fuel injection amounts of other cylinders are performed. In the rich imbalance diagnosis, a waveform of the air-fuel ratio A/F from the air-fuel ratio sensor 135*a* is monitored, and when an inclination kaf of the waveform exceeds the threshold kafth for determination, it is determined that rich imbalance occurs. The threshold kaft for determination is set as a value k times (for example, 1.2 times, 1.4 times, 1.6 times, or the like) the maximum value kref of the inclination of the waveform of the air-fuel ratio A/F from the air-fuel ratio sensor 135*a* when no abnormality occurs in the fuel injection system. In the lean imbalance diagnosis, it is determined whether or not lean imbalance occurs by the same method as in the rich imbalance diagnosis.

Figure 2:
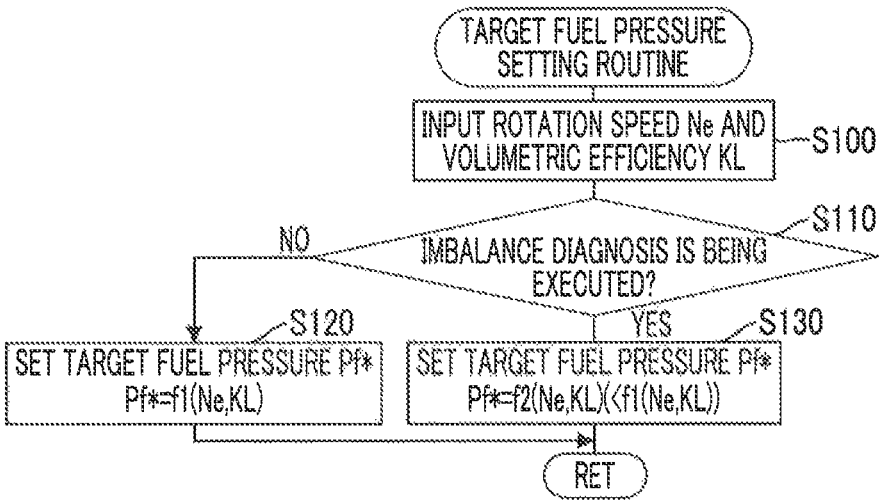
FIG. 2 is a flowchart showing an example of a target fuel pressure setting routine that is executed by an ECU 70 of the embodiment.

Next, the operation of the internal combustion engine device 10 of the embodiment configured as above, and in particular, an operation in a case of setting the target fuel pressure Pf* when the injection mode for execution is the in-cylinder injection mode will be described. FIG. 2 is a flowchart showing an example of a target fuel pressure setting routine that is executed by the ECU 70 of the embodiment. The routine is repeatedly executed at every predetermined time (for example, every several msec or the like) when the injection mode for execution is the in-cylinder injection mode.

When the routine is executed, the ECU 70 executes processing for inputting data, such as the rotation speed Ne or volumetric efficiency KL of the engine 12 (Step S100). As the rotation speed Ne, a rotation speed calculated based on the crank position θcr from the crank position sensor 140 is input. As the volumetric efficiency KL, volumetric efficiency calculated based on the intake air amount Qa from the air flowmeter 148 and the rotation speed Ne of the engine 12 is input.

Subsequently, it is determined that imbalance diagnosis is being executed (Step S110). When the above-described imbalance diagnosis execution condition is established, it is determined that the imbalance diagnosis is being executed.

When the imbalance diagnosis is not being executed, the target fuel pressure Pf* is set based on the input rotation speed Ne and volumetric efficiency KL (Step S120), and the routine ends. The target fuel pressure Pf* is defined as a value for allowing proper injection of fuel from the in-cylinder injection valve 125 in the in-cylinder injection mode in terms of improvement of fuel efficiency, improvement of riding comfort, and improvement of emission based on the rotation speed Ne and the volumetric efficiency KL. When the target fuel pressure Pf* is set in this manner, the ECU 70 drives and controls the high-pressure fuel pump 64 (electromagnetic valve 64*a*) such that the detected fuel pressure Pfdet becomes the target fuel pressure Pf*.

When the imbalance diagnosis is being executed, the target fuel pressure Pf* is set to be lower than the target fuel pressure Pf* settable in the processing of Step S120 based on the input rotation speed Ne and volumetric efficiency KL (Step S130), and the routine ends. The target fuel pressure Pf* is defined as a value smaller than the target fuel pressure Pf* settable in the processing of Step S120 and for allowing injection of fuel from the in-cylinder injection valve 125 in the in-cylinder injection mode in terms of suppression deterioration of fuel efficiency, riding comfort, and emission based on the rotation speed Ne and the volumetric efficiency KL. When the target fuel pressure Pf* is set in this manner, the high-pressure fuel pump 64 is driven and controlled such that the detected fuel pressure Pfdet becomes the target fuel pressure Pf*. The reason that the target fuel pressure Pf* is set so as to be lower than the target fuel pressure Pf* settable in the processing of Step S120 will be described.

Figure 3:
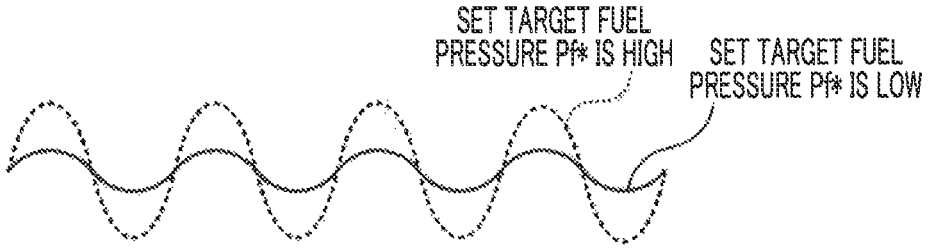
FIG. 3 is an explanatory view showing an example of change in fuel pressure in a delivery pipe 66, in the drawing, a broken line indicating change in fuel pressure in a case where target fuel pressure Pf* is higher than a solid line.
Figure 4:
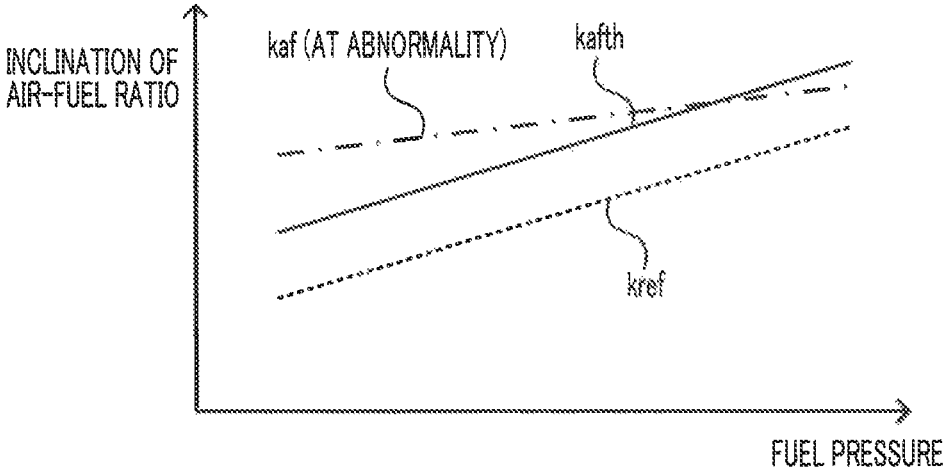
FIG. 4 is an explanatory view showing an example of the relationship of fuel pressure in the delivery pipe 66, a maximum value kref (broken line) of an inclination of a wavelength of an air-fuel ratio A/F from an air-fuel ratio sensor 135*a* when no abnormality occur in a fuel injection system, a threshold kafth for determination (=kref×k, solid line), and an inclination kaf (one-dot-chain line) when large variation in fuel injection amount between cylinders occurs due to the occurrence of an abnormality in the fuel injection system.

FIG. 3 is an explanatory view showing an example of change in fuel pressure in the delivery pipe 66. In the drawing, a broken line indicates behavior of fuel pressure in a case where the target fuel pressure Pf* is higher than a solid line. FIG. 4 is an explanatory view showing an example of the relationship of fuel pressure in the delivery pipe 66, the maximum value kref (broken line) of the inclination of the waveform of the air-fuel ratio A/F from the air-fuel ratio sensor 135*a* when no abnormality occurs in the fuel injection system, the threshold kafth for determination (=kref×k, solid line), and the inclination kaf (one-dot-chain line) when large variation in fuel injection amount between cylinders occurs due to the occurrence of an abnormality in the fuel injection system. Pulsation occurs in fuel pressure in the delivery pipe 66 due to the driving of the high-pressure fuel pump 64. When pulsation occurs in fuel pressure, even in a case where no abnormality occurs in the fuel injection system, variation in fuel pressure occurs at an injection timing between cylinders, variation in fuel injection amount between cylinders occurs, and fluctuation of the air-fuel ratio occurs. The amplitude of pulsation of fuel pressure in the delivery pipe 66 becomes larger when the target fuel pressure Pf* is high than when the target fuel pressure Pf* is low. In detail, the larger the target fuel pressure Pf*, the larger the amplitude of pulsation of fuel pressure. When the amplitude of pulsation of fuel pressure becomes large, variation in fuel injection amount between the cylinders becomes large, even when no abnormality occurs in the fuel injection system, change in air-fuel ratio becomes large, and the maximum value kref becomes large. For this reason, the threshold kafth for determination is set to a large value. As shown in FIG. 4, when an abnormality occurs in the fuel injection system, change in the inclination kaf with respect to fuel pressure is small. Accordingly, when the threshold kafth for determination becomes large, the threshold kafth for determination exceeds the inclination kaf when large variation in fuel injection amount between the cylinders occurs, and the imbalance diagnosis may not be executed with high accuracy. In the embodiment, since the target fuel pressure Pf* is set to fuel pressure lower than fuel pressure set in the processing of Step S120, pulsation of fuel pressure in the delivery pipe 66 becomes smaller, the maximum value kref becomes small, and the threshold kafth for determination is less than the inclination kaf. With this, it is possible to execute the imbalance diagnosis with higher accuracy.

With the internal combustion engine device 10 of the embodiment described above, when the imbalance diagnosis is executed, fuel pressure lower than the target fuel pressure Pf* settable when the imbalance diagnosis is not executed is set as the target fuel pressure Pf*, and the high-pressure fuel pump 64 is driven and controlled such that the detected fuel pressure Pfdet becomes the target fuel pressure Pf*, whereby it is possible to execute the imbalance diagnosis with higher accuracy.

In the internal combustion engine device 10 of the embodiment, although the target fuel pressure Pf* is set based on the rotation speed Ne and the volumetric efficiency KL of the engine 12 in the processing of Step S120, the target fuel pressure Pf* may be set to for example, a given value, such as 15 MPa, 16 MPa, or 17 Mpa. Fuel pressure Pfu1 (for example, 12 MPa, 13 MPa, 14 MPa, or the like) may be set until a predetermined number (for example, once, twice, three times, or the like for each cylinder) of fuel injections from the in-cylinder injection valve 125 are completed after the operation of the engine 12 starts, and thereafter, fuel pressure Pfu2 (for example, 15 MPa, 16 MPa, 17 Mpa, or the like) higher than the fuel pressure Pfu1 may be set. In this case, in the processing of Step S130, since fuel pressure lower when the imbalance diagnosis is not executed may be set as the target fuel pressure Pf*, the target fuel pressure Pf* may be set to, for example, a given value, such as 9 MPa, 10 MPa, or 11 MPa.

In the internal combustion engine device 10 of the embodiment, although it is determined whether or not imbalance of the fuel injection amount between the cylinders occurs using the waveform of the air-fuel ratio A/F from the air-fuel ratio sensor 135*a* in the imbalance diagnosis, it may be determined whether or not imbalance of the fuel injection amount between the cylinders occurs using a required time T30 required when the crank position θcr from the crank position sensor 140 rotates by 30 degrees from a top dead center of each cylinder. It may be determined whether or not imbalance of the fuel injection amount between the cylinders occurs using the waveform of the air-fuel ratio A/F from the air-fuel ratio sensor 135*a* in the rich imbalance diagnosis, and it may be determined whether or not lean imbalance of the fuel injection amount between the cylinders using the required time T30 in the lean imbalance diagnosis.

The correspondence relationship between the primary components of the embodiment and the primary components of the disclosure described in SUMMARY will be described. In the embodiment, the engine 12 is an example of an "internal combustion engine". The fuel supply device 60 is an example of a "fuel supply device". The electronic control unit (ECU) 70 is an example of "control means" and "diagnosis means".

The correspondence relationship between the primary components of the embodiment and the primary components of the disclosure described in SUMMARY should not be considered to limit the components of the disclosure described in SUMMARY since the embodiment is only illustrative to specifically describe the aspects of the disclosure. That is, the disclosure described in SUMMARY should be interpreted based on the description in SUMMARY, and the embodiment is only a specific example of the disclosure described in SUMMARY.

Although the mode for carrying out the disclosure has been described above in connection with the embodiment, the present disclosure is not limited to the embodiment, and can be of course carried out in various forms without departing from the spirit and scope of the present disclosure.

The present disclosure is usable in a manufacturing industry of an internal combustion engine device, or the like.

What is claimed is:

1. A control device for an internal combustion engine, the internal combustion engine being a multi-cylinder internal combustion engine including an in-cylinder injection valve configured to inject fuel into a cylinder of the internal combustion engine, the control device comprising:

a fuel supply device including a high-pressure fuel pump configured to pressurize fuel from a fuel tank and to supply the fuel to a supply flow passage connected to the in-cylinder injection valve; and an electronic control unit configured to:

control the high-pressure fuel pump such that fuel pressure in the supply flow passage becomes target fuel pressure, execute imbalance diagnosis for determining whether or not imbalance of a fuel injection amount between cylinders occurs based on fluctuation of an air-fuel ratio, and set a value of the fuel pressure to the target fuel pressure such that the imbalance diagnosis is executed based on a first threshold, the first threshold being based on a maximum value of fluctuation of an air-fuel ratio when an abnormality does not occur, wherein the first threshold is less than a first inclination, the first inclination being based on fluctuation of an air-fuel ratio when an abnormality occurs, the value of the fuel pressure being a value of the fuel pressure when the imbalance diagnosis is executed and being smaller than a value of the fuel pressure when the imbalance diagnosis is not executed.

2. The control device according to claim 1, wherein the electronic control unit is configured to calculate the target fuel pressure based on volumetric efficiency and a rotation speed of the internal combustion engine, the volumetric efficiency being a ratio of volume of air actually sucked in one cycle to stroke volume of the internal combustion engine per cycle.

3. The control device according to claim 1, wherein the electronic control unit is configured to set a given value of the fuel pressure to the target fuel pressure, the given value being a value of the fuel pressure when the imbalance diagnosis is executed and being smaller than a value of the fuel pressure when the imbalance diagnosis is not executed.

4. The control device according to claim 1, wherein the electronic control unit is configured to determine whether or not the imbalance occurs using an inclination of change in the air-fuel ratio.

5. The control device according to claim 1, wherein the electronic control unit is configured to:

(i) calculate a required time required when a crankshaft of the internal combustion engine rotates by a predetermined rotation angle, and (ii) determine whether or not the imbalance occurs using the required time.

6. The control device according to claim 1, wherein:

the internal combustion engine has a port injection valve configured to inject fuel to an intake port;

the fuel supply device has a first fuel pump and a second fuel pump;

the first fuel pump is configured to:

(i) pressurize fuel from the fuel tank, and (ii) supply high-pressure fuel to a first supply flow passage as the supply flow passage, the second fuel pump is configured to supply fuel from the fuel tank to a second supply flow passage connected to the port injection valve; and the electronic control unit is configured to:

(i) control the internal combustion engine such that the internal combustion engine operates in any of a port injection mode in which the internal combustion engine operates with fuel injection exclusively from the port injection valve, an in-cylinder injection mode in which the internal combustion engine operates with fuel injection exclusively from the in-cylinder injection valve, and a common injection mode in which the internal combustion engine operates with fuel injection from the port injection valve and the in-cylinder injection valve, and set a value of the fuel pressure to the target fuel pressure, the value of the fuel pressure being a value of the fuel pressure when the imbalance diagnosis is executed in the in-cylinder injection mode and being smaller than a value of the fuel pressure when the imbalance diagnosis is not executed in the an in-cylinder injection mode.

* * * * *